United States Patent [19]

Appleman

[11] Patent Number: 4,640,342

[45] Date of Patent: Feb. 3, 1987

[54] EXPANDABLE ANTIVIBRATION BAR FOR HEAT TRANSFER TUBES OF A PRESSURIZED WATER REACTOR STEAM GENERATOR

[75] Inventor: Robert H. Appleman, Pleasant Hills, Pa.

[73] Assignee: Westinghouse Electric Corp., Pittsburgh, Pa.

[21] Appl. No.: 574,304

[22] Filed: Jan. 26, 1984

[51] Int. Cl.[4] ..... F28F 7/00

[52] U.S. Cl. ..... 165/69; 122/510

[58] Field of Search ..... 165/69, 162; 122/510

[56] References Cited

U.S. PATENT DOCUMENTS

| | | | |
|---|---|---|---|
| 3,007,679 | 11/1961 | Byerley et al. | 165/69 X |
| 3,637,008 | 1/1972 | Michel et al. | 165/69 |
| 3,720,259 | 3/1973 | Fritz et al. | 165/162 |
| 3,742,567 | 7/1973 | Kaelin | 165/162 X |
| 4,204,570 | 5/1980 | Eisinger | 165/69 |
| 4,286,366 | 9/1981 | Vinyard | 165/69 |
| 4,319,725 | 3/1982 | Meuschke | 165/69 |

FOREIGN PATENT DOCUMENTS

| | | | |
|---|---|---|---|
| 2252545 | 11/1974 | France | 165/69 |
| 1404643 | 9/1975 | United Kingdom | 165/162 |

*Primary Examiner*—Albert W. Davis, Jr.
*Assistant Examiner*—Peggy Neils
*Attorney, Agent, or Firm*—Daniel C. Abeles

[57] ABSTRACT

An expandable antivibration bar for use in stabilizing the U-bend portion of heat transfer tubes in a pressurized water reactor steam generator comprises two adjustable rods connected together by an arcuate connector. The two adjustable rods preferably comprise two mating rod sections having complementary angular sliding surfaces thereon, with means provided to move the rod sections relative to each other along the sliding surfaces so as to expand the rods from a first mated cross-sectional width to a second larger cross-sectional width. The ends of the rod sections have means for aligning the two rod sections and maintaining them in alignment during expansion.

16 Claims, 10 Drawing Figures

EXPANDABLE ANTIVIBRATION BAR FOR HEAT TRANSFER TUBES OF A PRESSURIZED WATER REACTOR STEAM GENERATOR

BACKGROUND OF THE INVENTION

The present invention relates to an expandable antivibration bar for use in stabilizing the U-tube sections of heat transfer tubes in the steam generator of a pressurized water reactor.

In pressurized water nuclear reactors, a pressurized fluid is passed through the reactor core and, after being heated, is passed through heat transfer tubes that are positioned in a secondary side of a steam generator where the heat is transferred to a secondary fluid to produce steam that is used to operate a turbine for production of electrical power.

The tubes in the secondary side of the steam generator are of an inverted U-shape design, and since numerous rows and columns of such tubes are present, in a closely packed array, it is important to stabilize the tubes against vibration which causes wear or damage to the tubes. The straight portions of the tubes are supported and stabilized by the use of a series of separator plates, while the U-bend portions of the tubes are supported by antivibration bars. In using the antivibration bars, however, the bars must be slightly smaller than the space between adjacent rows of tubes in order to permit insertion of the bars between such rows. There is still, therefore, a problem which exists due to the size of antivibration bars that can be used in that a potential for some vibration and impacting and wear is still present between the tubes and the bars. Tube wear beyond acceptable limits requires removal of the tube from service, such as by plugging of the tube.

SUMMARY OF THE INVENTION

An expandable antivibration bar for use in stabilizing heat transfer tubes, and an improved pressurized water reactor steam generator, are provided wherein the bars comprise a pair of expandable rods affixed together by an arcuate connector. Each of said rods is comprised of two mating rod sections which have confronting angular surfaces in mated position so as to provide a first cross-sectional width of less than the spacing between the U-tube section of adjacent rows of heat transfer tubes, with means provided to move one of said rod sections relative to the other along the angular surfaces to expand the rod to a second cross-sectional width greater than the first cross-sectional width, such that the expanded rods will close the gap and may touch the heat transfer tubes of adjacent rows of tubes.

In a preferred embodiment, one of said rod sections has protrusions thereon which mate with indentations in the other of said rod sections, and one end of the one rod has depressions which fit within rims on the other rod section, and an aperture is provided in the one rod section which communicates with slots within the rims, with a pin secured in the aperture and extending into said slots. The one rod section has a channel at the other end which receives a ridge on the other rod section, the channel having a depending leg with a threaded aperture therethrough, and the ridge having a bore therein aligned with said aperture. A bolt is threadable in the aperture which fits within the bore to move one section relative to the other along the angular surfaces to expand the cross-sectional width of the mated sections.

DETAILED DESCRIPTION

Figure 1:
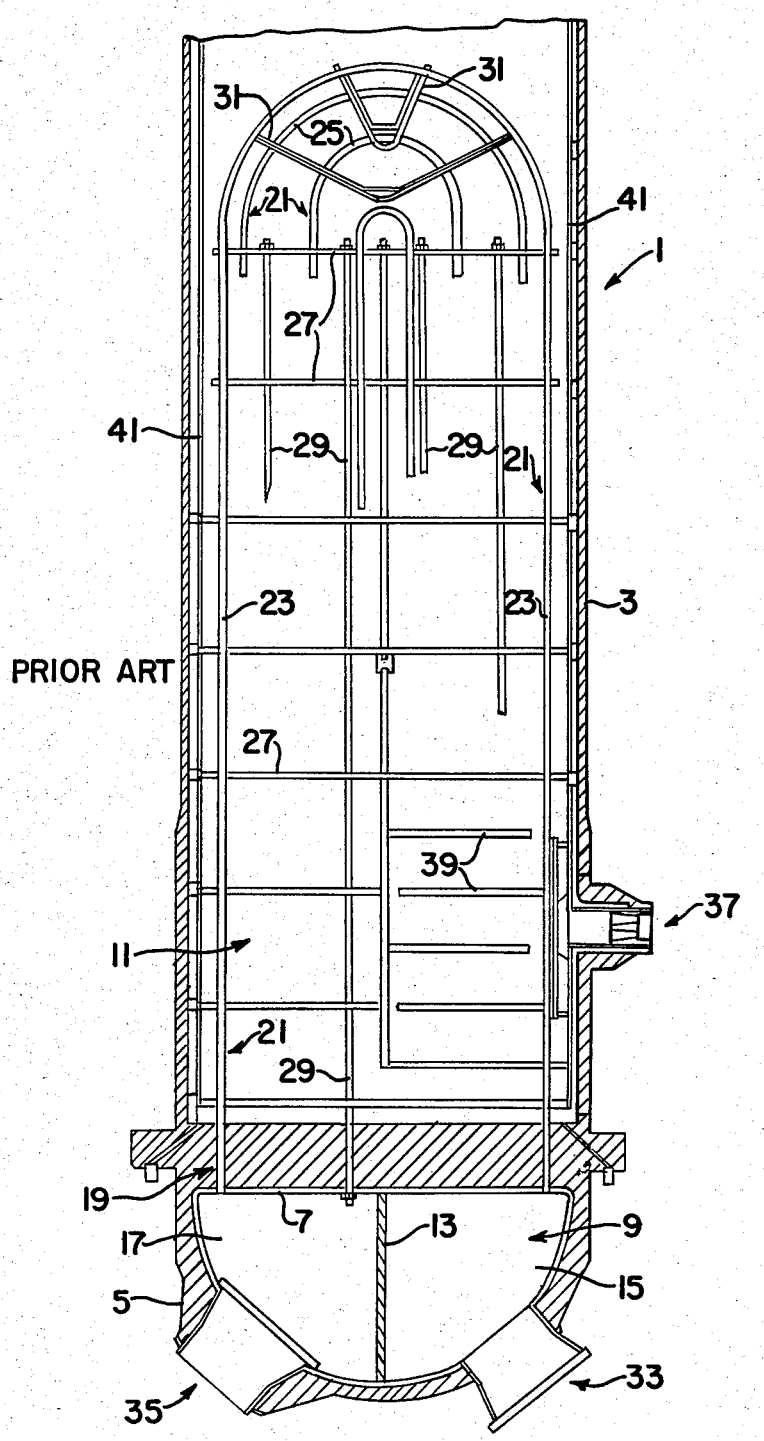
FIG. 1 is a vertical section taken through a pressurized water reactor steam generator with some parts removed for clarity, showing a prior art type of antivibration bar at the U-bend region of heat transfer tubes.

Referring now to FIG. 1, there is illustrated a steam generator 1, for a pressurized water reactor comprising a cylindrical body portion 3 that is fitted at its lower end to a hemispherical shell 5. A transverse steel plate 7, called a tubesheet, at the lower end of the cylindrical portion 3 divides the steam generator into a primary side 9 below the tubesheet and a secondary side 11 above the tubesheet. The primary side 9, which is also referred to as the channel head, is divided in half by a vertical divider plate 13 into an outlet section 15 and an inlet section 17.

The tubesheet 7 is provided with an array of thousands of holes 19, through which several thousand U-shaped heat transfer tubes 21 are inserted. The U-shaped tubes 21 each have leg portions 23 and a U-bend portion 25. The leg portions 23 are inserted into corresponding holes 19 on opposite sides of the tubesheet 7, so that one end of each U-shaped tube 21 communicates with the inlet section 17 of the channel head and the other end communicates with the outlet section 15. The leg portions 23 of the U-shaped tubes 21 are supported and stabilized on the secondary side 11 of the generator by a series of separator plates 27 which are stabilized transversely and which are braced by tie rods 29. The U-bend portions 25 of the U-shaped tubes are normally stabilized by a plurality of rigid antivibration bars 31.

In operation of the generator, primary coolant from the reactor enters the inlet side 17 of the channel head through inlet 35, circulates through the U-shaped tubes 21 and exits the outlet side 15 of the channel head through outlet 33. Secondary water introduced into the secondary side 11 of the generator 1 through secondary water inlet 37 circulates around the tubes 21 where it is converted into steam by heat released by the primary coolant passing through the tubes 21. Baffles 39 form a preheater section which initially directs the secondary water around the outlet side of the tubes 21 for increased efficiency. The steam produced in the secondary side 11 rises into a steam drum (not shown), where water droplets are removed by demisters, and passes out of the generator through a secondary outlet (not shown).

The U-shaped tubes 21 are normally arranged in a series of rows and columns which are oriented vertically to form a basically dome-shaped pattern when viewed from above. A metallic cylindrical sheet or wrapper 41 is situated about the bundle of tubes 21 in the secondary side 11 of the generator and is spaced from the wall of the secondary side 11. The rigid antivibration bars 31, as used in the prior art to stabilize the U-bend portion of the tubes are inserted between adjacent rows of the tubes and fixed by a ring-like support on the top of the tube bundle.

In the present invention, an expandable antivibration bar is provided which enables the bar to be inserted between the U-bend portion of adjacent rows of tubes while the bar is of a first width, and then sections of the bar are expanded so as to provide a tight fit of the bar between the two rows of tubes which prevents vibration.

Figure 2:
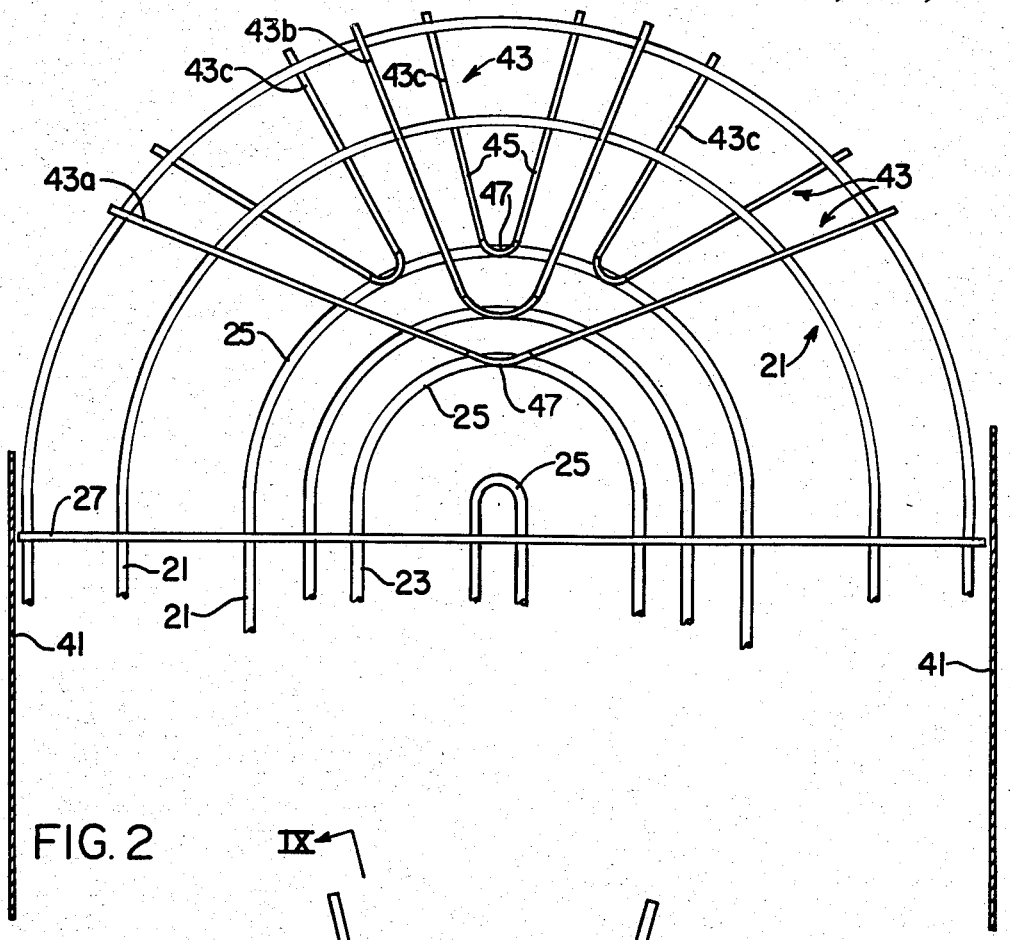
FIG. 2 is a schematic illustration of a plurality of expandable antivibration bars of the present invention in a section of a heat transfer tube assembly.
Figure 3:
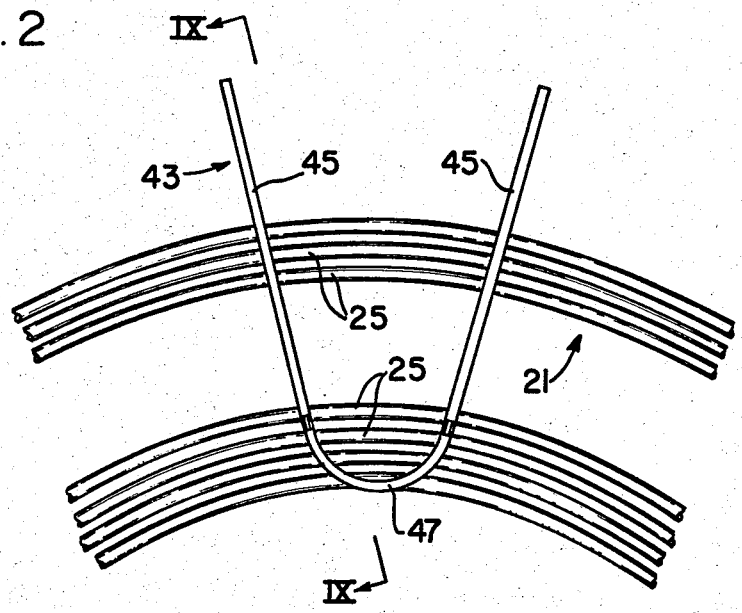
FIG. 3 is a view of a single expandable antivibration bar of the present invention in position in a section of a heat transfer tube assembly.

As illustrated in FIGS. 2 and 3, the expandable antivibration bar 43 of the present invention is comprised of a pair of adjustable rods 45 and a connector 47, the connector preferably being of an arcuate shape. Each of the pair of rods 45 are fixed to the connector such as by welding to form a V-shaped antivibration bar. The angle formed between the two rods 45 will vary depending upon the position of the bar within the tube bundle. For example, with bar 43*a*, an angle of about 140° is present, with bar 43*b*, an angle of about 45° is present, while with bars 43*c*, an angle of about 30° is used.

Figure 4:
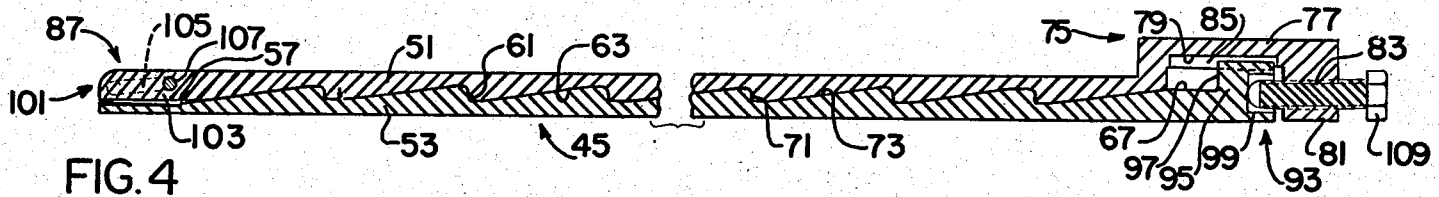
FIG. 4 is a vertical sectional view of an embodiment of the adjustable rod used in the expandable antivibration bar of the present invention, the rod sections in mated and unexpanded position.
Figure 5:
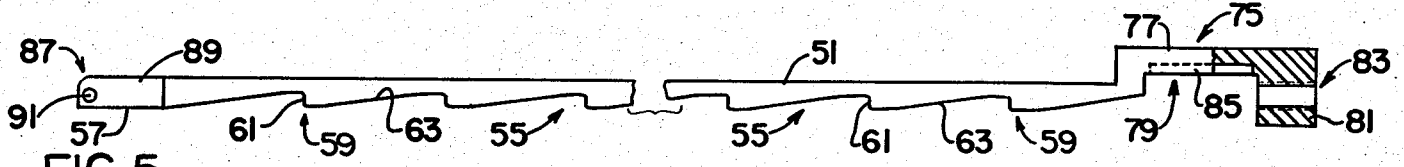
FIG. 5 is a view, with a portion cut away, of one of the mating rod sections illustrated in FIG. 4.
Figure 6:
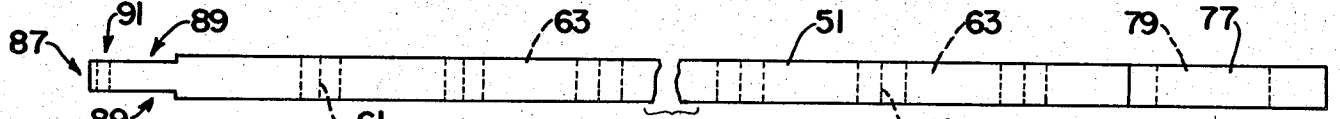
FIG. 6 is a plan view of the one mating rod section illustrated in FIG. 5.
Figure 7:
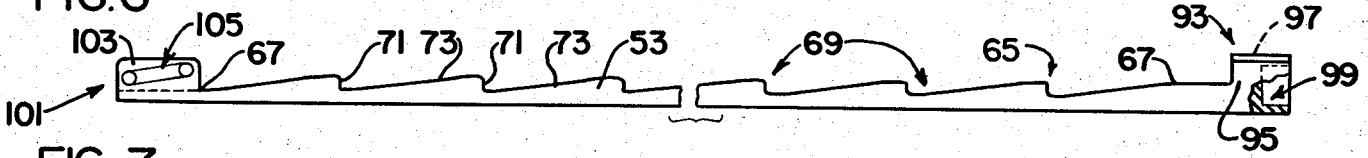
FIG. 7 is a view, with a portion cut away, of the other mating rod section illustrated in FIG. 4.
Figure 8:
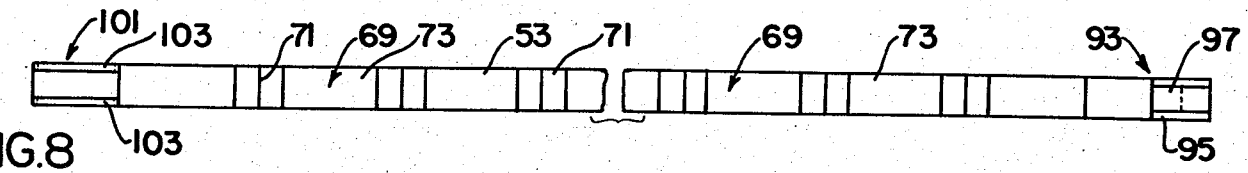
FIG. 8 is a plan view of the other mating rod section illustrated in FIG. 7.

An embodiment of the adjustable rods 45 is described in FIGS. 4 through 8, which illustrate a pair of mating sections, a top section 51 and bottom section 53 having confronting surfaces. The top section 51 has a series of grooves 55 in the confronting surface 57 thereof which form a plurality of protrusions 59, each having a shoulder 61 and an inclined sliding surface 63. The bottom section 53 has a series of grooves 65 in the confronting surface 67 thereof which form a plurality of indentations 69, each having a shoulder 71 and an inclined sliding surface 73. The inclined surfaces 63 and 73 and the positioning of the shoulders 61 and 71 are complementary such that the two confronting surfaces 57 and 67 mate together and are flush when the rod is in its unexpanded position, as illustrated in FIG. 4.

Means are provided on the two mating sections 51 and 53 to effect movement of one of the rod sections relative to the other such that the width of the rod is enlarged. As illustrated, the top section 51 has at one end 75 thereof a flange 77, which flange 77 has a channel 79 formed therein, the flange 77 having a downwardly depending leg 81, with a threaded aperture 83 provided in the leg 81. A raised portion 85 is provided along the floor of the channel 79. At the other end 87 of the top section 51, on both sides thereof there are provided recessed portions 89, and an aperture 91 is provided through the top section at said recessed portions.

The bottom section 53 has at one end 93 a ridge 95, which fits within the channel 79 of the flange 77 of the top section 51, the ridge 95 having a notch 97 therein which will receive the raised portion 85 in the channel 79 of the top section 51. The ridge 97 has in the end thereof a bore 99. The other end 101 of the bottom section 53 is provided with a pair of upwardly projecting rims 103, one on each side thereof. Each of the rims 103 has a slot 105 formed therethrough, extending at an angle from the horizontal equal to the angle to the horizontal formed by the inclined surfaces 73 of the indentations 69 in the bottom section 53.

In mating the top section 51 and bottom section 53, the former is superimposed over the latter such that the end 87 of the top section, with recesses 89, fits between the rims 103 of the bottom section, while the ridge 93 of the bottom section sits within the channel 79 of the top section, with raised portion 85 seated within the notch 97. A pin 107 is then fitted through the two slots 105 and aperture 91 with the pin 107 fixed in place by friction fit in aperture 91, or welding or other means, while the ends of the pin are slidably retained in the slots 105. The bore 99 of the bottom section 53 is in alignment with the threaded aperture 83 in the top section 51 and a threaded bolt 109 threadedly engaged in the aperture and moves towards the bottom of the bore 99. The pin 107 and bolt 109 with retain the two sections 51 and 53 in superimposed position while enabling sliding motion between the two. If desired, further means for maintaining the superimposed position, such as lugs (not shown) on the side of either section extending partway across the other section may be welded to one of the sections.

Figure 9:
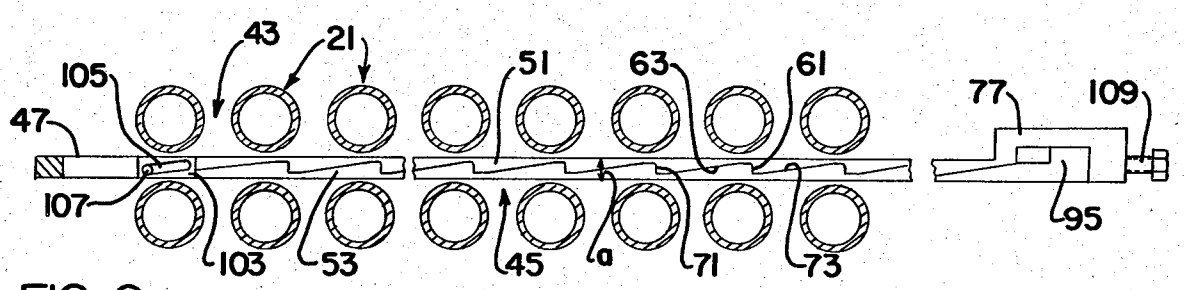
FIG. 9 is a view taken along line IX—IX of FIG. 3, showing the expandable antivibration bar of the present invention between two adjacent rows of heat transfer tubes, in unexpanded position.
Figure 10:
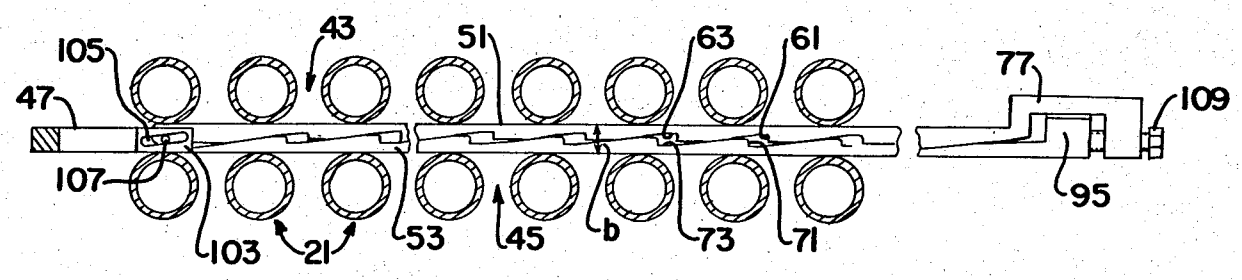
FIG. 10 is a view, as in FIG. 9, with the expandable antivibration bar of the present invention in expanded position.

In order to expand the width of the adjustable rod 45, after mating of the top and bottom sections, where the rod will have a first cross-sectional width a (FIG. 9), the threaded bolt 109 is threaded in aperture 83 of the top section 51 towards the bottom of the bore 99 in the bottom section 53, until contact with the bottom of the bore 99 is achieved. Continued threading of the bolt 109 will cause movement of the bottom section 53, with the pin 107 sliding in the slots 105, while the sliding surfaces 73 of the bottom section 53 will slide along the sliding surfaces 63 of the top section 51. After such slidable movement of bottom section 53 relative to top section 51, the width of the rod 45 will have expanded to a second cross-section width b greater than the first cross-sectional width a (FIG. 10). The antivibration bars of the present invention can be fixed in place on the tube bundle by a ring-like support, as are prior art antivibration bars.

In another embodiment of the present invention, the adjustable rods may be used as a means for determining the distance between adjacent rows of heat transfer tubes. In order to use an adjustable rod as a measuring device, the threaded bolt may be provided with a calibration device, such that the advanced position of the bolt can be used to calibrate the distance between rows of heat transfer tubes.

What is claimed is:

1. An expandable antivibration bar for use in stabilizing the heat transfer tubes of adjacent rows of tubes of a steam generator, in the U-tube section of said heat transfer tubes, comprising:

a pair of adjustable rods, each comprising a pair of mating rod sections, said sections having confronting angular surfaces in mated position to provide a first cross-sectional width of the rod, one rod section of said pair of rod sections having a plurality of protrusions, each of said protrusions having slidable surfaces thereon, and the other rod section of said pair of rod sections having a plurality of indentations, each of said indentations having slidable surfaces thereon complementary to the sliding surfaces of said protrusions;

means for moving one of said mated sections relative to the other section along said angular surfaces so as to expand the rod to a second cross-sectional width greater than said first cross-sectional width; and a connector to which each of said pair of adjustable rods is affixed.

2. The expandable antivibration bar as defined in claim 1 wherein said connector has an arcuate configuration.

3. The expandable antivibration bar as defined in claim 1 wherein one rod section of said pair of rod sections has depressions at one end thereof and the other rod section of said pair of rod sections has a pair of rims thereon, with said end of the rod section with depressions fitting within said rims.

4. The expandable antivibration bar as defined in claim 3 wherein the end of said one rod section with said depressions has an aperture therethrough and the rims of said other rod section has slots therein which communicate with said aperture, and a pin is secured within said aperture and extends into and is slidable in said slots.

5. The expandable antivibration bar as defined in claim 4 wherein said slots extend at an angle from the horizontal equal to the angle from the horizontal of the slidable surface of the indentations of said other rod section.

6. The expandable antivibration bar as defined in claim 1 wherein said one of said pair of rod sections has a channel at one end thereof, and said other of said pair of rod sections has a ridge thereon which fits within said channel.

7. The expandable antivibration bar as defined in claim 6 wherein said channel has a depending leg which has a threaded aperture therethrough, and said ridge has a bore therein aligned with said threaded aperture, and a bolt is provided in said threaded aperture which extends into said bore, said bolt being movable into said bore to move said one rod section relative to said other rod section.

8. The expandable antivibration bar as defined in claim 7 wherein a raised portion is provided in said channel, along the floor of said channel, and a notch is provided on the ridge of the other rod section, with the notch of said ridge movable along said said raised portion.

9. In a pressurized water reactor steam generator having a plurality of spaced rows of heat transfer tubes through which primary coolant from the reactor flows, the tubes being of a U-shaped design, with the U-bend portions of the U-shaped tubes stabilized by antivibration bars, the improvement comprising:

a plurality of expandable antivibration bars for stabilizing the U-bend portions of said U-shaped tubes, said expandable bars having a pair of adjustable rods, formed from a pair of rod sections affixed to a connector, one rod section of each of said pair of rod sections having a plurality of protrusions, each of said protrusions having slidable surfaces thereon, and the other rod section of each of said pair of rod sections having a plurality of indentations, each of said indentations having slidable surfaces thereon complementary to the sliding surfaces of said protrusions, such that the rods are expandable from a first cross-sectional width less than the spacing between two adjacent rows of said tubes, to a second cross-sectional width greater than said first cross-sectional width, whereby said expanded rods are adapted to contact tubes of the two adjacent rows of said tubes.

10. In a pressurized water reactor steam generator as defined in claim 9, the improvement wherein said connector has an arcuate configuration.

11. In a pressurized water reactor steam generator as defined in claim 9, the improvement wherein one rod section of said pair of rod sections has depressions at one end thereof and the other rod section of said pair of rod sections has a pair of rims thereon, with said end of the rod section with depressions fitting within said rims.

12. In a pressurized water reactor steam generator as defined in claim 11, the improvement wherein the end of said one rod section with said depressions has an aperture therethrough and the rims of said other rod section have slots therein which communicate with said aperture, and a pin is secured within said aperture and extends into and is slidable in said slots.

13. In a pressurized water reactor steam generator as defined in claim 12, the improvement wherein said slots extend at an angle from the horizontal equal to the angle from the horizontal of the slidable surface of the indentations of said other rod section.

14. In a pressurized water reactor steam generator as defined in claim 9, the improvement wherein said one of said pair of rod sections has a channel at one end thereof, and said other of said pair of rod sections has a ridge thereon which fits within said channel.

15. In a pressurized water reactor steam generator as defined in claim 14, the improvement wherein said channel has a depending leg which has a threaded aperture therethrough, and said ridge has a bore therein aligned with said threaded aperture, and a bolt is provided in said threaded aperture which extends into said bore, said bolt being movable into said bore to move said one rod section relative to said other rod section.

16. In a pressurized water reactor steam generator as defined in claim 15 the improvement wherein a raised portion is provided in said channel, along the floor of said channel, and a notch is provided on the ridge of the other rod section, with the notch of said ridge movable along said raised portion.

* * * * *